US007418984B2

(12) United States Patent
Ansaloni

(10) Patent No.: US 7,418,984 B2
(45) Date of Patent: Sep. 2, 2008

(54) METHOD AND WHEEL FOR TRANSFERRING TOP SHELLS OF CAPSULES ON A MACHINE FOR FILLING CAPSULES WITH AT LEAST ONE PHARMACEUTICAL PRODUCT

(75) Inventor: Angelo Ansaloni, Crespellano (IT)

(73) Assignee: MG2 - S.R.L., Pianoro (IT)

( * ) Notice: Subject to any disclaimer, the term of this patent is extended or adjusted under 35 U.S.C. 154(b) by 567 days.

(21) Appl. No.: 11/227,449

(22) Filed: Sep. 15, 2005

(65) Prior Publication Data

US 2006/0059867 A1 Mar. 23, 2006

(30) Foreign Application Priority Data

Sep. 17, 2004 (IT) ..... BO2004A0577

(51) Int. Cl.
*B65B 43/42* (2006.01)
*B65B 1/00* (2006.01)

(52) U.S. Cl. ..... 141/145; 141/2; 141/144; 141/168; 53/272

(58) Field of Classification Search ..... 141/2, 141/144, 145, 165, 168, 369; 53/53, 272, 53/299, 454, 467, 476, 505, 506, 900; 198/399
See application file for complete search history.

(56) References Cited

U.S. PATENT DOCUMENTS

| | | | | |
|---|---|---|---|---|
| 4,343,130 | A * | 8/1982 | Facchini | 53/272 |
| 4,964,262 | A | 10/1990 | Moser et al. | |
| 5,074,102 | A * | 12/1991 | Simpson et al. | 53/454 |
| 5,240,049 | A * | 8/1993 | Chiari | 141/81 |
| 6,327,835 | B1 * | 12/2001 | Trebbi | 53/53 |
| 6,941,980 | B2 * | 9/2005 | Rocchio et al. | 141/67 |
| 7,140,403 | B2 * | 11/2006 | Gamberini | 141/83 |
| 7,210,507 | B2 * | 5/2007 | Facchini | 141/146 |
| 7,328,559 | B2 * | 2/2008 | Gamberini | 53/560 |

FOREIGN PATENT DOCUMENTS

| | | |
|---|---|---|
| GB | 2 149 740 | 6/1985 |

* cited by examiner

*Primary Examiner*—Timothy L Maust
(74) *Attorney, Agent, or Firm*—Ladas & Parry LLP

(57) ABSTRACT

On a continuous machine for filling capsules with at least one pharmaceutical product, the top shell of a capsule is transferred by advancing the top shell inside a relative seat, which is normally connected to a suction device to retain the top shell as of a loading station, and is connected to a blow device to release the top shell at an unloading station; pneumatic connection of the seat to the suction device being cut off upstream from the loading station in a travelling direction of the seat, so as to pick up the top shell directly at the loading station.

10 Claims, 5 Drawing Sheets

METHOD AND WHEEL FOR TRANSFERRING TOP SHELLS OF CAPSULES ON A MACHINE FOR FILLING CAPSULES WITH AT LEAST ONE PHARMACEUTICAL PRODUCT

The present invention relates to a method for transferring top shells of capsules on a machine for filling capsules with at least one pharmaceutical product.

BACKGROUND OF THE INVENTION

In the pharmaceutical industry, a machine is known for filling capsules, each comprising a bottom shell and a top shell closing the bottom shell.

The machine normally comprises a first wheel, on which each capsule is first positioned vertically, with the top shell on top of the bottom shell, and then opened; a conveying line connected to the first wheel to pick up the bottom shells successively and feed them along a given first path extending through at least one metering and filling device; a second wheel connected to the first wheel to pick up the top shells successively at a first transfer station; and a third wheel connected to the second wheel to receive the top shells successively at a second transfer station, and connected to the conveying line to successively receive the bottom shells, each of which is closed with the respective top shell.

The second wheel cooperates with the first and third wheel to feed each top shell along a second path of substantially the same length as the first path, and therefore in time with the relative bottom shell, comprises at least one seat for a top shell, and is mounted to rotate about a respective axis of rotation to feed the seat through the first and second transfer station.

The seat is normally connected to a suction device for removing the top shell off the first wheel and feeding it along the second path, and is connected, at the second transfer station, to a blow device to release the top shell onto the third wheel.

Given the relatively severe centrifugal forces to which the top shells of the capsules are subjected by the operating speeds of the first and second wheel, that the first and second wheel must differ fairly considerably in diameter to achieve the same length for both paths, and that the seat is normally connected to the suction device, known capsule filling machines of the above type have several drawbacks, mainly due to transfer of the top shells between the first and second wheel normally commencing upstream from the first transfer station, and so jeopardizing correct positioning of the top shells inside the seat on the second wheel and on the third wheel, and therefore closure of the relative bottom shells.

Failure to close a bottom shell results in stoppage of the machine to remove the bottom shell and relative top shell off the third wheel, and in fairly considerable downtime.

SUMMARY OF THE INVENTION

It is an object of the present invention to provide a method of transferring top shells of capsules on a machine for filling capsules with at least one pharmaceutical product, designed to eliminate the aforementioned drawbacks.

According to the present invention, there is provided a method of transferring top shells of capsules on a machine for filling capsules with at least one pharmaceutical product, as claimed in the attached claims.

The present invention also relates to a wheel for transferring top shells of capsules on a machine for filling capsules with at least one pharmaceutical product.

According to the present invention, there is provided a wheel for transferring top shells of capsules on a machine for filling capsules with at least one pharmaceutical product, as claimed in the attached claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
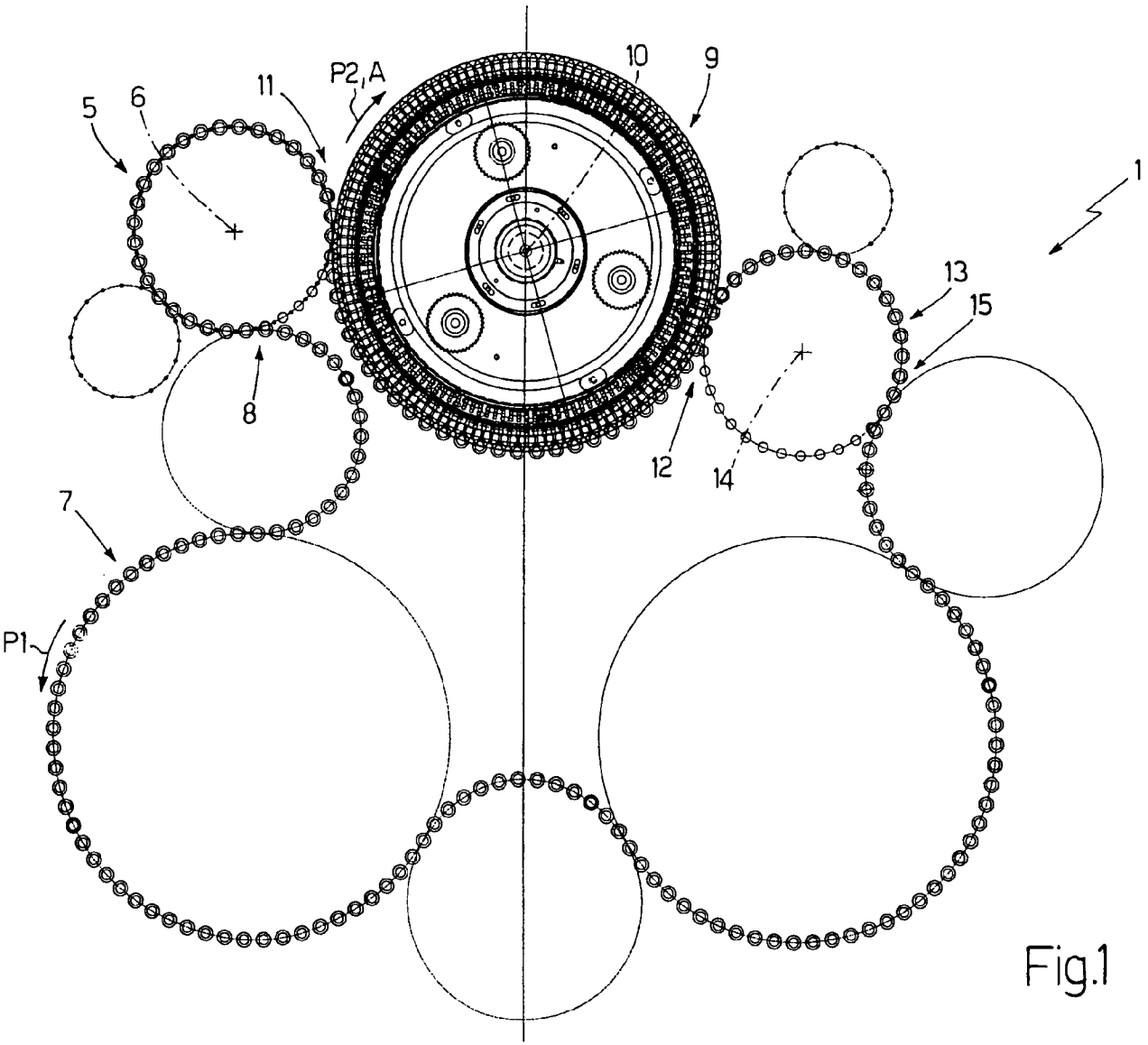
FIG. 1 shows a schematic plan view of a preferred embodiment of the capsule filling machine according to the present invention.

Number 1 in FIG. 1 indicates as a whole a machine for filling known capsules 2 (FIGS. 2 to 4) with at least one pharmaceutical product. Each capsule 2 comprises a substantially cup-shaped bottom shell 3, and a top shell 4 for closing bottom shell 3.

Machine 1 comprises a known positioning and opening wheel 5 mounted to rotate continuously about a respective longitudinal axis 6 perpendicular to the FIG. 1 plane, and which receives closed empty capsules 2 successively, positions each capsule 2 vertically with top shell 4 on top of relative bottom shell 3, and opens each capsule 2 by removing top shell 4 from relative bottom shell 3.

Bottom shells 3 are picked up successively by a known conveying device 7 connected to wheel 5 at a first transfer station 8, and which feeds bottom shells 3 along a given path P1 and through at least one metering device (not shown) which feeds said pharmaceutical product into bottom shells 3.

Top shells 4 are picked up successively by a transfer wheel 9 mounted to rotate continuously about a respective longitudinal axis 10, parallel to axis 6, and connected to wheel 5 at a second transfer station 11, and are transferred at a third transfer station 12 to a known closing wheel 13 mounted to rotate continuously about a respective longitudinal axis 14, parallel to axes 6 and 10, and connected to device 7 at a fourth transfer station 15 to receive bottom shells 3 successively.

Wheels 5, 9, 13 are designed to feed each top shell 4 between stations 8 and 15 along a path P2 of substantially the same length as path P1, and therefore in time with relative bottom shell 3, to allow wheel 13 to close the capsules 2 opened on wheel 5.

Figure 2:
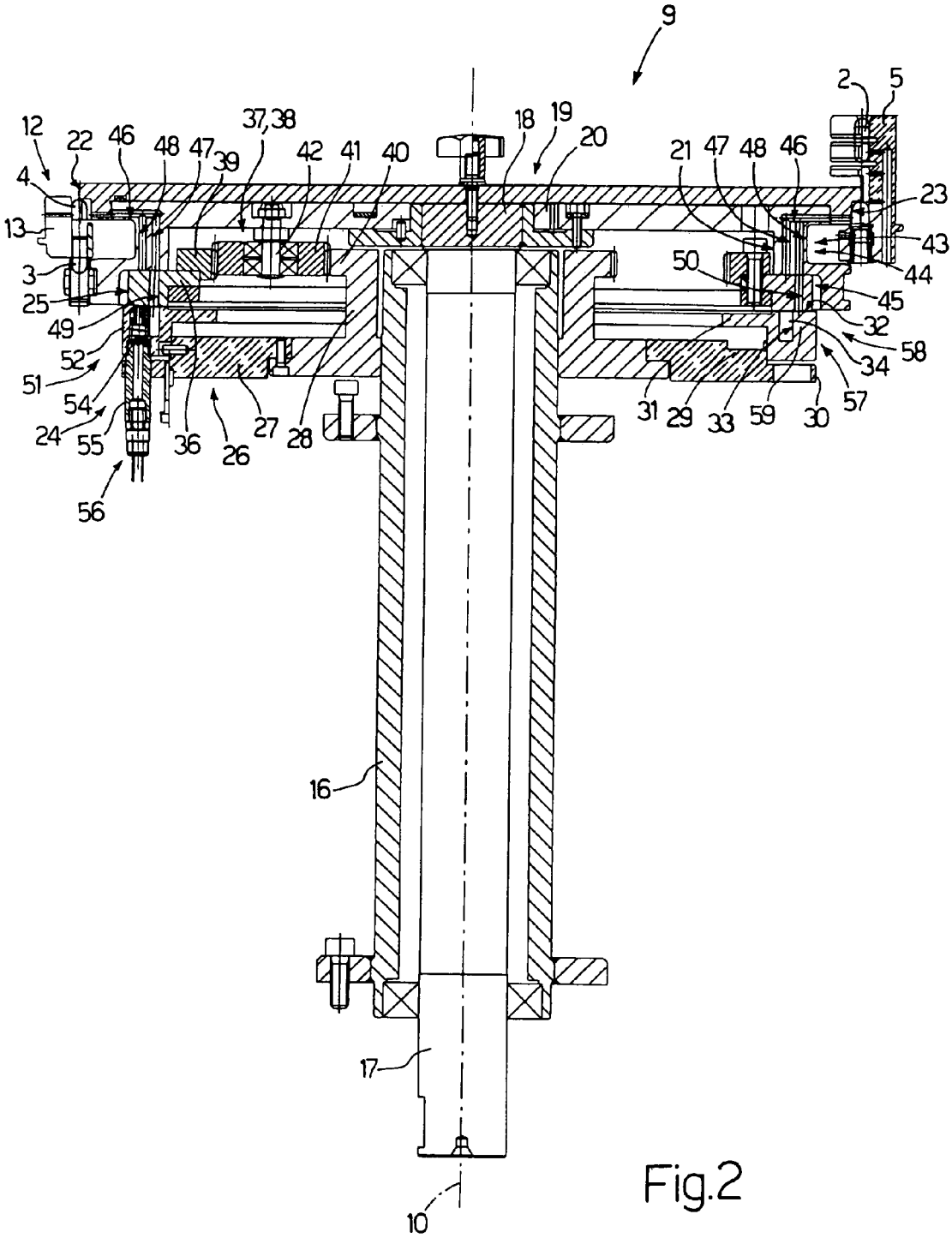
FIGS. 2 to 4 show schematic longitudinal sections of a detail of FIG. 1 in different operating positions.
Figure 3:
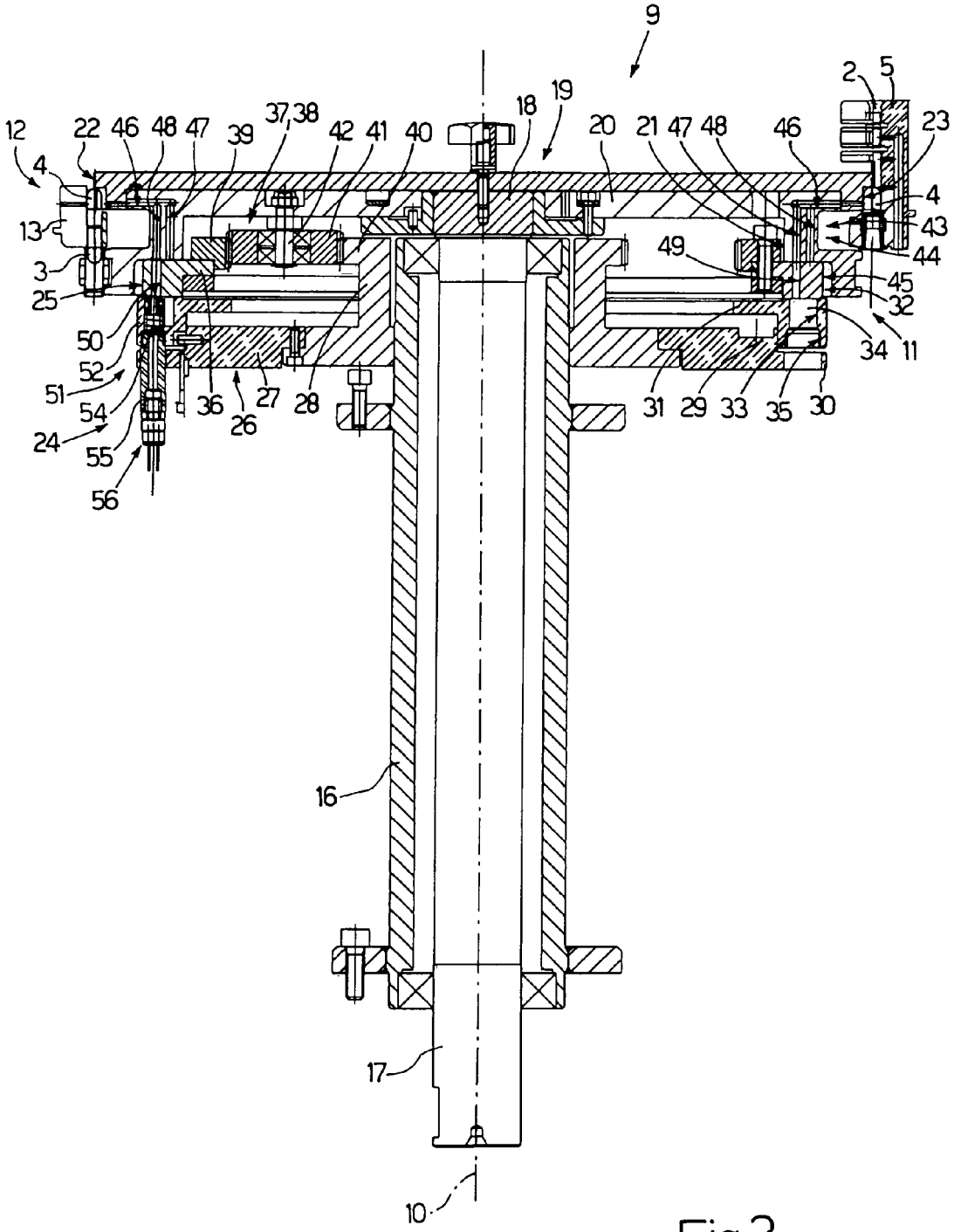
Figure 4:
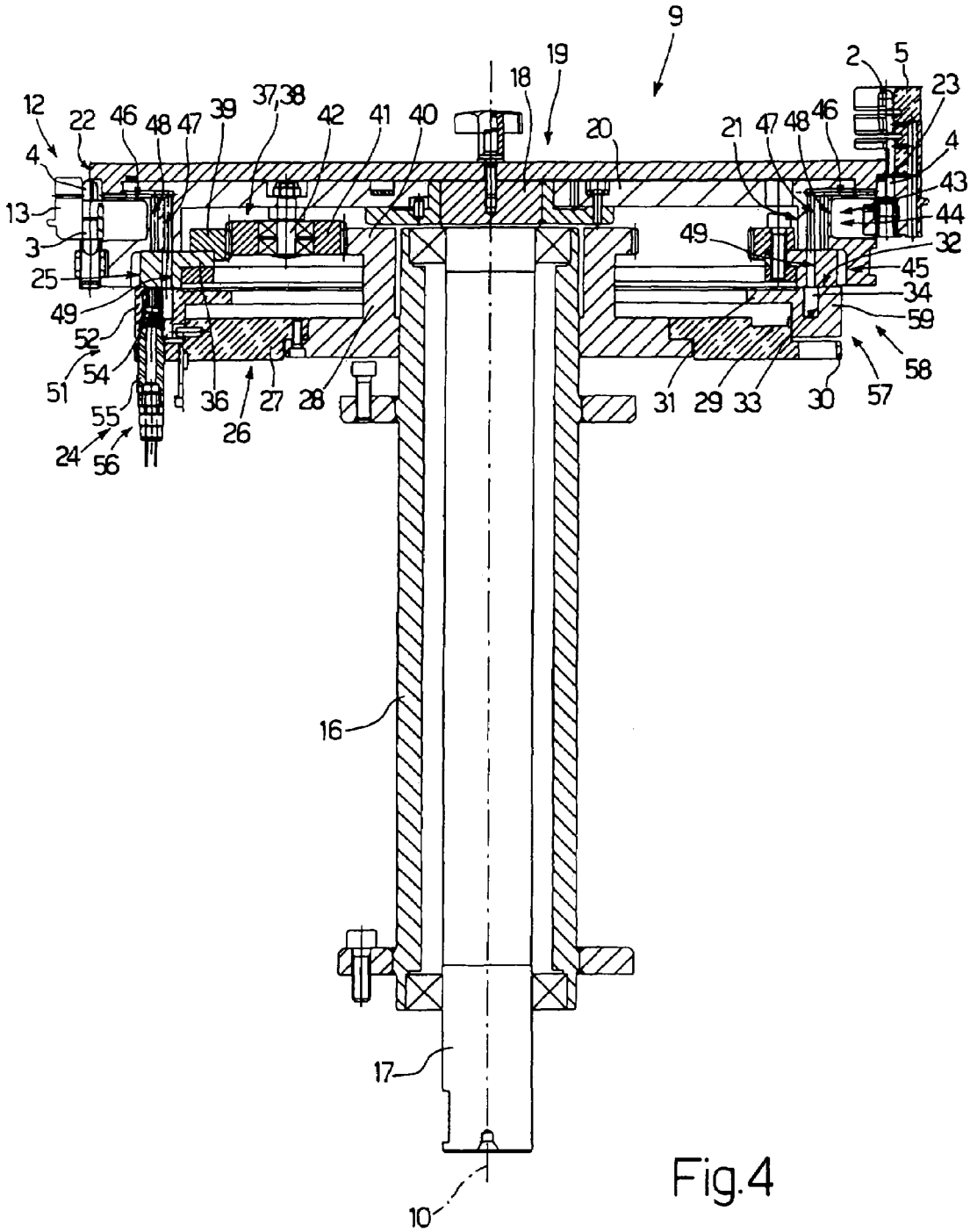
Figure 5:
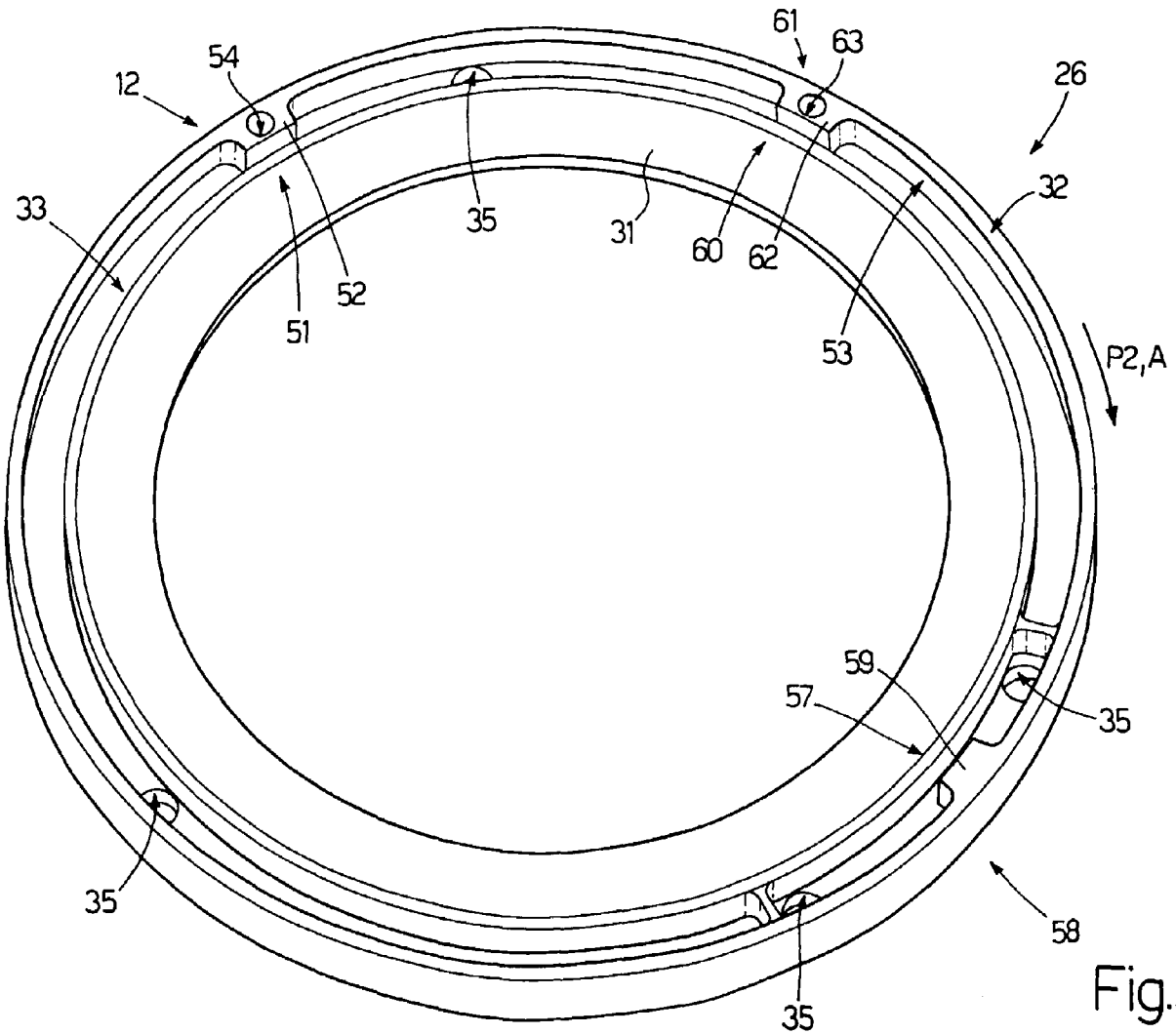
FIG. 5 shows a view in perspective of a detail in FIGS. 2 to 4.

With reference to FIGS. 2 to 4, wheel 9 comprises a tubular column 16 fixed to the frame (not shown) of machine 1 coaxially with axis 10; and a shaft 17, which engages column 16 in rotary and axially-fixed manner to rotate, with respect to column 16 and under the control of a known actuating device not shown, in a given direction A (clockwise in FIG. 1) about axis 10, and has a top end 18 projecting outwards of column 16.

End 18 of shaft 17 supports a substantially cup-shaped drum 19, which is positioned with its concavity facing downwards, is bounded axially by an end wall 20 fixed to end 18 and perpendicular to axis 10, is bounded internally by a step surface 21, and is bounded externally by a lateral surface 22 coaxial with axis 10.

A number of seats 23 are formed in surface 22, are equally spaced about axis 10, have a substantially V-shaped cross section, and are connected to a pneumatic device 24, common to all of seats 23, so as each to remove a respective top shell 4 off wheel 5 at station 11, feed top shell 4 along path P2 between stations 11 and 12, and release top shell 4 onto wheel 13 at station 12.

Device 24 comprises two pneumatic distributors 25, 26, of which, distributor 25 is a rotary distributor, and distributor 26 a fixed distributor located beneath distributor 25.

As shown in FIGS. 2 to 5, distributor 26 comprises an annular plate 27, which projects radially outwards from column 16, has a collar 28 extending upwards from plate 27 coaxially with axis 10, and in turn comprises a narrow top portion 29 and a wide bottom portion 30, and an annular disk 31, which is fitted to portion 29 coaxially with axis 10, is locked angularly to plate 27, and is fitted in sliding manner to plate 27 with the interposition of known springs (not shown).

Disk 31 is bounded at the top by a flat surface 32 perpendicular to axis 10, and has an annular cavity 33, which extends about axis 10, opens outwards at surface 32, and is closed by distributor 25 to define a suction chamber 34, which communicates with a known suction device (not shown) by means of a number of (in the example shown, four) holes 35 formed through plate 27 and disk 31 and parallel to axis 10.

Distributor 25 comprises an annular plate 36, which is mounted inside drum 19 coaxially with axis 10, is positioned contacting both surface 21 and surface 32, and is fitted in rotary manner to collar 28 to rotate about axis 10 with respect to collar 28 and distributor 26, and under the control of an actuating device 37.

Device 37 comprises an epicyclic gear train 38 for rotating distributor 25 about axis 10 at a different rotation speed from that of drum 19 about axis 10, and which in turn comprises an external ring gear 39 fixed to plate 36 coaxially with axis 10; a sun gear 40 formed on a top free end of collar 28; and a number of (in the example shown, three) planet gears 41 interposed between ring gear 39 and sun gear 40, equally spaced about axis 10, and mounted idly on respective supporting pins 42 projecting downwards from end wall 20 of drum 19.

Suction chamber 34 communicates pneumatically with seats 23 via a pneumatic circuit 43 comprising a first portion 44 formed through drum 19; and a second portion 45 formed through plate 36 of distributor 25.

For each seat 23, portion 44 comprises a respective radial conduit 46 opening outwards at surface 22 and relative seat 23; and a respective pair of axial conduits 47, 48, which extend parallel to axis 10, communicate with conduit 46, are aligned radially with each other, and open outwards at surface 21 and plate 36.

Portion 45 comprises a first number of axial conduits 49, which extend through plate 36, are parallel to and equally spaced about axis 10, communicate pneumatically with chamber 34, and have respective longitudinal axes at substantially the same distance from axis 10 as the longitudinal axes of conduits 47.

Portion 45 also comprises a second number of axial conduits 50, which extend through plate 36, are parallel to axis 10, are equally spaced about axis 10 and conduits 49, are offset circumferentially with respect to conduits 49, normally communicate with chamber 34, and have respective longitudinal axes at substantially the same distance from axis 10 as the longitudinal axes of conduits 48.

Operation of transfer wheel 9 will be described with reference to FIGS. 2 to 5, and assuming transfer of one top shell 4, inside relative seat 23, from transfer station 11 to transfer station 12.

Given that conduits 47 and 48 associated with conduit 46 of the seat 23 considered are aligned radially with each other, that conduits 49 and 50 are offset circumferentially, and that drum 19 and, therefore, conduits 47 and 48 are rotated about axis 10 at a different rotation speed from that of plate 36 and, therefore, of conduits 49 and 50 about axis 10, conduit 46 is normally connected to suction chamber 34 by relative conduit 47 and a conduit 49, or by relative conduit 48 and a conduit 50, so as to enable the seat 23 considered to pick up relative top shell 4 at transfer station 11, and feed top shell 4 along path P2.

For the seat 23 considered to release top shell 4, transfer station 12 has a switching device 51 for cutting off pneumatic connection between the seat 23 considered and suction chamber 34, and which comprises an on-off member defined by a plate 52, which projects radially towards axis 10 from an outer lateral surface 53 of disk 31, extends a given angle about axis 10, is shaped so as only to be engaged by conduits 50 as they travel about axis 10, and has a through hole 54 formed through disk 31, parallel to axis 10, to receive and retain a nozzle 55 of a compressed-air device 56.

Given that path P1 of bottom shells 3 and path P2 of top shells 4 must be of the same length, and that, in the example shown, transfer wheel 9 has a relatively small diameter, the seat 23 considered must feed relative top shell 4 first from station 11 to station 12, then from station 12 to station 11, and finally again from station 11 to station 12 to release top shell 4 onto closing wheel 13.

In this connection, the gear ratio between drum 19 and plate 36 is such that:

when the seat 23 considered travels first through station 12, conduit 46 is connected pneumatically to suction chamber 34 by relative conduit 47 and a conduit 49; relative conduit 48 is disconnected pneumatically from all of conduits 50; and top shell 4 is retained inside seat 23 (FIG. 2); and when the seat 23 considered travels for the second time through station 12, conduit 46 is connected pneumatically to compressed-air device 56 by relative conduit 48, one of conduits 50, and hole 54; relative conduit 47 is disconnected pneumatically from all of conduits 49; and top shell 4 is pushed out of seat 23 onto closing wheel 13 (FIG. 3).

For top shell 4 to be picked up precisely at transfer station 11 and in the correct, i.e. vertical, position, pneumatic distributor 26 has an on-off device 57, which is located at an on-off station 58 upstream from station 11 in the rotation direction A of wheel 9, cuts off pneumatic connection between the seat 23 considered and suction chamber 34, and comprises a plate 59, which projects radially towards axis 10 from surface 53, extends a given angle about axis 10, and is shaped so as only to be engaged by conduits 50 as they travel about axis 10.

As described relative to switching device 51, the gear ratio between drum 19 and plate 36 is such that:

when the seat 23 considered travels first through station 58, relative conduit 47 is disconnected pneumatically from all of conduits 49; relative conduit 48 is connected pneumatically to one of conduits 50, which, however, is closed by plate 59; and conduit 46 is therefore disconnected pneumatically from suction chamber 34 at station 58 (FIG. 2), and is reconnected to suction chamber 34 by relative conduit 47 and by one of conduits 49 precisely at station 11 (FIG. 3); and when the seat 23 considered travels the second time through station 58, conduit 46 is connected pneumatically to suction chamber 34 by relative conduit 47 and one of conduits 49; relative conduit 48 is disconnected pneumatically from all of conduits 50; and top shell 4 is retained inside seat 23 through station 58 (FIG. 4).

Finally, pneumatic distributor 26 has a switching device 60, which is located at an ejection station 61 downstream from station 12 in rotation direction A of wheel 9, cuts off pneumatic connection between the seat 23 considered and suction chamber 34, and comprises an on-off member defined by a plate 62, which projects radially towards axis 10 from surface 53, extends a given angle about axis 10, is shaped so as only to be engaged by conduits 50 as they travel about axis 10, and has a through hole 63 formed through disk 31, parallel to axis 10, to receive and retain a nozzle (not shown) of compressed-air device 56.

As described relative to switching device 51 and on-off device 57, the gear ratio between drum 19 and plate 36 is such that:

when the seat 23 considered travels first through station 61, conduit 46 is connected pneumatically to suction chamber 34 by relative conduit 47 and one of conduits 49; relative conduit 48 is disconnected pneumatically from all of conduits 50; and top shell 4 is retained inside seat 23 through station 61; and when the seat 23 considered travels through station 61 for the second time, relative conduit 47 is disconnected pneumatically from all of conduits 49; and conduit 46 is connected pneumatically to compressed-air device 56 by relative conduit 48, one of conduits 50, and hole 63, so as to expel from seat 23 a top shell 4 not transferred to closing wheel 13 at transfer station 12.

Transfer wheel 9 therefore feeds each seat 23 successively :

through on-off station 58, with pneumatic connection between seat 23 and suction chamber 34 cut off;

through transfer station 11, with pneumatic connection between seat 23 and suction chamber 34 activated, to remove relative top shell 4 from positioning and opening wheel 5 precisely at transfer station 11;

through transfer station 12, ejection station 61, and again through on-off station 58 and transfer station 11, with pneumatic connection between seat 23 and suction chamber 34 still activated, and pneumatic connection between seat 23 and compressed-air device 56 still deactivated, to retain top shell 4 inside seat 23;

again through transfer station 12, with pneumatic connection between seat 23 and suction chamber 34 deactivated, and pneumatic connection between seat 23 and compressed-air device 56 activated, so as to release top shell 4 onto closing wheel 13; and again through ejection station 61, with pneumatic connection between seat 23 and suction chamber 34 deactivated, and pneumatic connection between seat 23 and compressed-air device 56 activated, so as to expel top shell 4 from seat 23, if top shell 4 has not been transferred correctly to closing wheel 13 at transfer station 12.

It should be pointed out that plate 52 of switching device 51 at transfer station 12 and plate 59 of on-off device 57 at on-off station 58 have respective radial planes of symmetry, which form a whole multiple angle of an angle depending on the gear ratio between drum 19 and plate 36.

The invention claimed is:

1. A transfer wheel for transferring top shells (4) on a machine for filling capsules (2) with at least one pharmaceutical product; each capsule (2) comprising a bottom shell (3), and a top shell (4) for closing the bottom shell (3); the transfer wheel comprising at least one seat (23) for a relative top shell (4); a loading station (11) for picking up the top shell (4); an unloading station (12) for releasing the top shell (4), the transfer wheel being mounted to rotate continuously about a respective longitudinal axis (10) and feed said seat (23) through said loading and unloading stations (11, 12); a suction device (34) normally connected to the seat (23) to pick up the relative top shell (4) at said loading station (11) and feed the top shell (4) along a given path (P2) extending between the loading and unloading stations (11, 12); and a blow device (56) connectable pneumatically to the seat (23) to release the relative top shell (4) at the unloading station (12) at the end of said path (P2); and the transfer wheel being characterized by also comprising on-off means (57) for cutting off pneumatic connection between the suction device (34) and the seat (23) upstream from the loading station (11) in a travelling direction (A) of the transfer wheel about said axis (10).

2. A transfer wheel as claimed in claim 1, wherein the suction device (34) comprises a fixed annular suction chamber (34); and wherein the seat (23) is associated with a pneumatic circuit (43) for connecting the seat (23) pneumatically to the suction chamber (34), and which is movable about said axis (10); the on-off means (57) comprising a first plate (59) located inside the suction chamber (34) to cut off and close the pneumatic circuit (43) upstream from the loading station (11) in said travelling direction (A).

3. A transfer wheel as claimed in claim 2, and also comprising first switching means (51) located at the unloading station (12) to cut off pneumatic connection between the suction device (34) and the seat (23), and to activate pneumatic connection between the blow device (56) and the seat (23).

4. A transfer wheel as claimed in claim 3, wherein the first switching means (51) comprise a second plate (52), which is located inside the suction chamber (34) to cut off pneumatic connection between the suction chamber (34) and the pneumatic circuit (43), and has at least one pneumatic conduit (54) extending through the second plate (52) to connect the pneumatic circuit (43) pneumatically to the blow device (56).

5. A transfer wheel as claimed in claim 1, and also comprising an ejection station (61) for releasing a top shell (4) advanced by the seat (23) downstream from the unloading station (12) in said travelling direction (A).

6. A transfer wheel as claimed in claim 5, and also comprising second switching means (60) located at the ejection station (61) to cut off pneumatic connection between the suction device (34) and the seat (23), and to activate pneumatic connection between the blow device (56) and the seat (23).

7. A transfer wheel as claimed in claim 6, wherein the second switching means (60) comprise a third plate (62), which is located inside the suction chamber (34) to cut off pneumatic connection between the suction chamber (34) and the pneumatic circuit (43), and has at least one further pneumatic conduit (63) extending through the third plate (62) to connect the pneumatic circuit (43) pneumatically to the blow device (56).

8. A method of transferring top shells (4) of capsules (2) on a transfer wheel (9) of a machine for filling capsules (2) with at least one pharmaceutical product; each capsule (2) comprising a bottom shell (3), and a top shell (4) for closing the bottom shell (3); the transfer wheel (9) comprising at least one seat (23) for a top shell (4), and being mounted to rotate continuously about a respective longitudinal axis (10); the method comprising the steps of normally connecting the seat (23) to a suction device (34) to pick up the top shell (4) at a loading station (11) and feed the top shell (4) along a given path (P2) extending between the loading station (11) and an unloading station (12); and connecting the seat (23) to a blow device (56) to release the top shell (4) at the unloading station (12); and the method being characterized by also comprising the step of cutting off pneumatic connection between the suction device (34) and the seat (23) upstream from the loading station (11) in a travelling direction (A) of the transfer wheel (9) about said axis (10).

9. A method as claimed in claim 8, and also comprising the step of releasing a top shell (4) advanced by the seat (23) downstream from the unloading station (12) in said travelling direction (A).

10. A method as claimed in claim 9, wherein the top shell (4) advanced by the seat (23) downstream from the unloading station (12) in said travelling direction (A) is released by cutting off pneumatic connection between the suction device (34) and the seat (23), and activating pneumatic connection between the blow device (56) and the seat (23).

* * * * *